US007828234B1

(12) United States Patent
Hockmeyer et al.

(10) Patent No.: US 7,828,234 B1
(45) Date of Patent: Nov. 9, 2010

(54) BASKET MEDIA MILL WITH POROUS CONTAINMENT WALL AND METHOD

(76) Inventors: Herman H. Hockmeyer, 239 E. Saddle River Rd., Saddle River, NJ (US) 07458; Barry W. Cullens, 102 Eyrie La., Elizabeth City, NC (US) 27909

( * ) Notice: Subject to any disclaimer, the term of this patent is extended or adjusted under 35 U.S.C. 154(b) by 0 days.

(21) Appl. No.: 12/501,613

(22) Filed: Jul. 13, 2009

(51) Int. Cl.
*B02C 17/22* (2006.01)

(52) U.S. Cl. ..... 241/21; 241/171; 241/172

(58) Field of Classification Search ..... 241/21, 241/172, 74, 171; 29/428
See application file for complete search history.

(56) References Cited

U.S. PATENT DOCUMENTS 4,752,497 A * 6/1988 McConkey et al. ..... 427/470
5,184,783 A 2/1993 Hockmeyer et al.
6,029,915 A 2/2000 Inoue

* cited by examiner

*Primary Examiner*—Mark Rosenbaum
(74) *Attorney, Agent, or Firm*—Arthur Jacob

(57) ABSTRACT

The containment wall of a basket media mill is constructed of a porous synthetic polymeric material having porous openings each of a pore size less than the predetermined size of the media for confining the media within the bed in the basket as feedstock is passed through the porous openings in the containment wall. The containment wall extends over an overall area and the porous openings provide an open area through which the feedstock flows as the feedstock passes through the containment wall, and the open area is at least about fifteen percent of the overall area of the containment wall for enabling a concomitant increased volumetric flow of feedstock through the containment wall. A substantially flat sheet of porous synthetic polymeric material having porous openings is formed into a cylindrical configuration to establish a cylindrical containment wall with porous openings each increasing in pore size from the interior of the cylindrical wall toward the exterior of the cylindrical wall.

15 Claims, 2 Drawing Sheets

BASKET MEDIA MILL WITH POROUS CONTAINMENT WALL AND METHOD

The present invention relates generally to the dispersion of selected constituents into liquids through the utilization of a basket media mill in which solid constituents are finely divided and dispersed into a liquid vehicle, as in the manufacture of paints, coatings, inks and like products, and pertains, more specifically, to improvements in a basket media mill and method whereby a bed of very small media is contained within the basket of a basket media mill while the volumetric flow of feedstock through the media bed is increased to attain effective grinding and dispersion of very finely divided solids within the liquid of the feedstock.

An increasing demand for mixtures containing dispersions of very finely divided solids, such as inks utilized in ink-jet printers, cosmetics, pharmaceuticals and paints and other coatings exhibiting more well-defined colors in thinner layers, has given rise to a requirement for processing equipment and techniques which can produce the desired mixtures with greater ease, efficiency and economy. In an earlier patent, U.S. Pat. No. 5,184,783, the disclosure of which is incorporated herein by reference thereto, there is described a basket media mill of the type in which a basket containing a bed of grinding media is immersed within a mixture of liquid and solids to be dispersed in the liquid, held within a vessel, and the mixture is moved through the basket, and through the bed of media in the basket, to circulate the mixture in the vessel and divide and disperse the solids within the liquid vehicle.

While such basket media mills have proved to be highly effective in quickly processing mixtures of liquid with dispersions of solids, the demand for still finer and even ultra-fine dispersions has dictated the use of smaller grinding media; however, as the size of the grinding media is decreased, it becomes increasingly difficult to confine the media within the basket while still maintaining a volumetric flow of feedstock which can provide an efficient grinding and dispersion operation. The containment walls of baskets in conventional basket media mills usually are constructed of metal grids, sometimes in the form of metallic bar screens. These metallic structures provide openings small enough to contain grinding media for a wide range of dispersions; however, upon reducing the size of the openings so as to enable containment of smaller and smaller media, the proportion of open area to overall area of a metallic containment wall will decrease, with a concomitant decrease in throughput, resulting from a decreased volumetric flow of feedstock through the media bed and the basket wall.

The present invention provides improvements which enable the containment wall of a basket media mill to incorporate very small openings so that the basket of the basket mill will contain a media bed of very small media, while at the same time increased open area is made available at the containment wall for a concomitant increase in the volumetric flow of feedstock and the effective grinding and dispersal of fine and ultra-fine dispersions within the feedstock. As such, the present invention attains several objects and advantages, some of which are summarized as follows: Enables the processing of feedstock in a basket media mill to disperse more finely divided solids within the feedstock; enables an increased volumetric flow of feedstock through a basket media mill for accelerated processing of the feedstock; increases significantly the open area made available at the containment wall of the basket of a basket media mill for feedstock throughput in the basket media mill, thereby decreasing the dwell time per pass of feedstock through the media field contained within the basket and, consequently, enabling an increased number of passes for improved performance within a given time period; provides greater precision in the size of openings in the containment wall of a basket media mill for more precise control of the size of solids dispersed in the liquid of a selected feedstock; increases resistance to abrasion of the containment wall and consequent attrition of the material of the containment wall; provides better containment of media within the media bed of a basket media mill, thereby avoiding contamination of the feedstock with media; militates against contamination of the feedstock with particles which otherwise might be abraded from the material of the containment wall itself; provides for exemplary performance in the containment of media within the basket of a basket media mill over an extended service life.

The above objects and advantages, as well as further objects and advantages, are attained by the present invention which may be described briefly as providing, in a media basket mill having a basket with a containment wall establishing an interior for containing a bed of media of predetermined size within the basket, while feedstock comprised of solids entrained within a liquid vehicle is passed serially through the bed and thence through the containment wall to grind and disperse the solids within the liquid vehicle, an improvement wherein: the containment wall is constructed of a porous synthetic polymeric material having porous openings each of a pore size less than the predetermined size of the media for confining the media within the bed in the basket as feedstock is passed through the porous openings in the containment wall, the containment wall extending over an overall area and the porous openings providing an open area through which the feedstock will flow as the feedstock passes through the containment wall, the open area being at least about fifteen percent of the overall area of the containment wall for enabling a concomitant volumetric flow of feedstock through the containment wall.

In addition, the present invention provides, in a method for grinding and dispersing solids within a liquid vehicle in a feedstock passed through a media basket mill having a basket with a containment wall establishing an interior for containing a bed of media of predetermined size within the basket, while the feedstock is passed serially through the bed and thence through the containment wall, an improvement comprising: constructing the containment wall of a porous synthetic polymeric material having porous openings each of a pore size less than the predetermined size of the media, the containment wall extending over an overall area and the porous openings providing an open area through which the feedstock will flow as the feedstock is passed through the containment wall, and the open area being at least about fifteen percent of the overall area of the containment wall; and confining the media within the bed in the basket while passing the feedstock serially through the media bed and the porous openings in the containment wall, thereby enabling a concomitant volumetric flow of feedstock through the containment wall while the solids are ground and dispersed within the liquid vehicle of the feedstock.

Further, the present invention includes a method for making a cylindrical containment wall for a basket of a media basket mill wherein a bed of media of predetermined size is contained within the basket while feedstock comprised of solids entrained within a liquid vehicle is passed serially through the bed and thence through the containment wall to grind and disperse the solids within the liquid vehicle, the method comprising: starting with a substantially flat sheet of porous synthetic polymeric material having an obverse surface, a reverse surface and porous openings of predetermined size extending from the obverse surface to the reverse surface, bending the sheet into a cylindrical configuration to establish a cylindrical wall with the obverse surface extending along an exterior of the cylindrical wall and the reverse surface extending along an interior of the cylindrical wall such that the porous openings each increase in pore size from the interior of the cylindrical wall toward the exterior of the cylindrical wall; and securing the sheet in the cylindrical configuration to maintain the cylindrical wall.

The invention will be understood more fully, while still further objects and advantages will become apparent, in the following detailed description of preferred embodiments of the invention illustrated in the accompanying drawing, in which.

Figure 1:
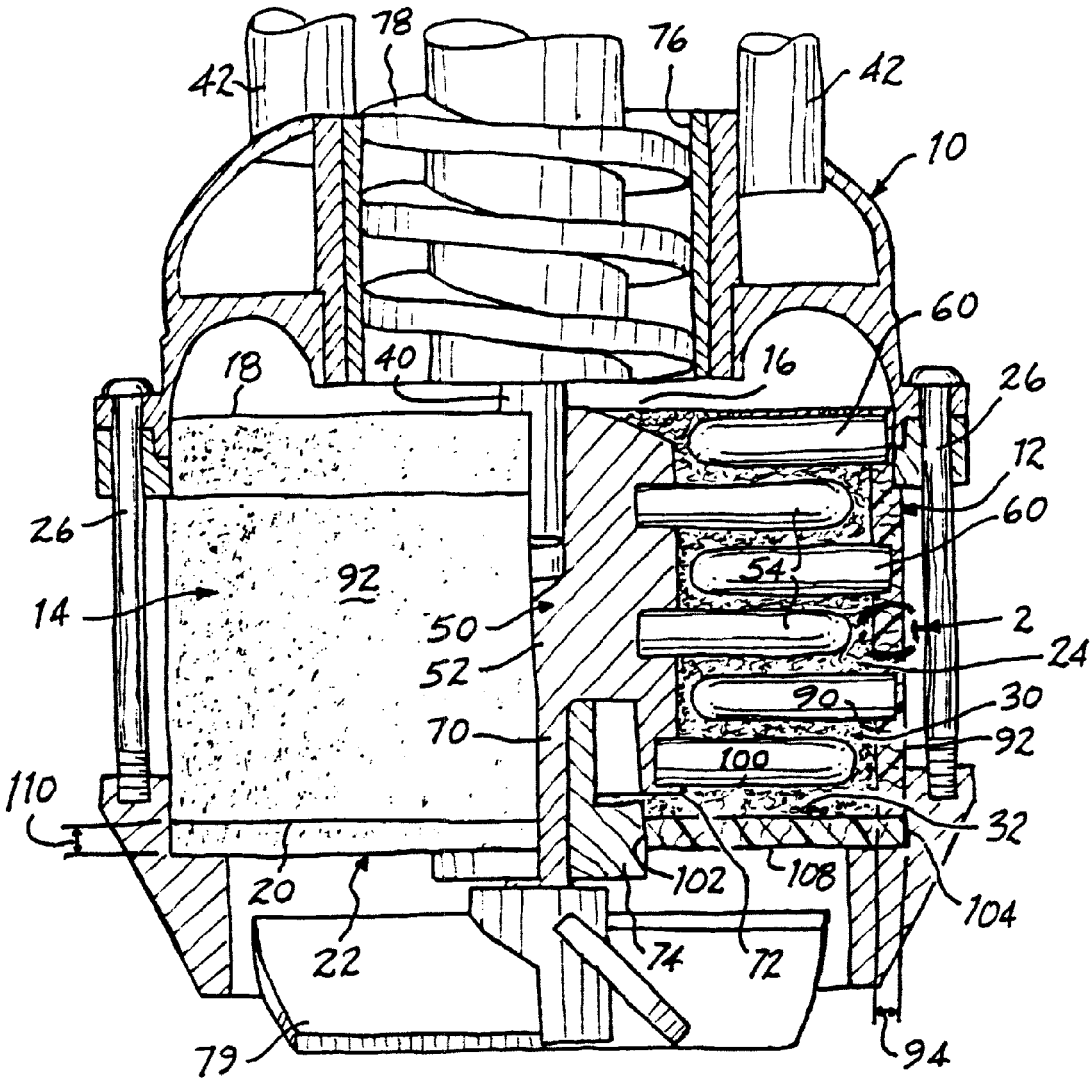
FIG. 1 is a somewhat diagrammatic elevational view, shown partially in cross-section, illustrating a basket media mill constructed in accordance with the present invention.
Figure 2:
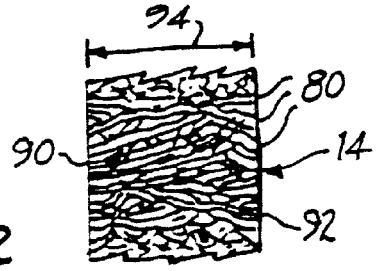
FIG. 2 is an enlarged fragmentary view, rendered in a partially diagrammatic form, of a portion of FIG. 1 indicated by arrow 2.
Figure 3:
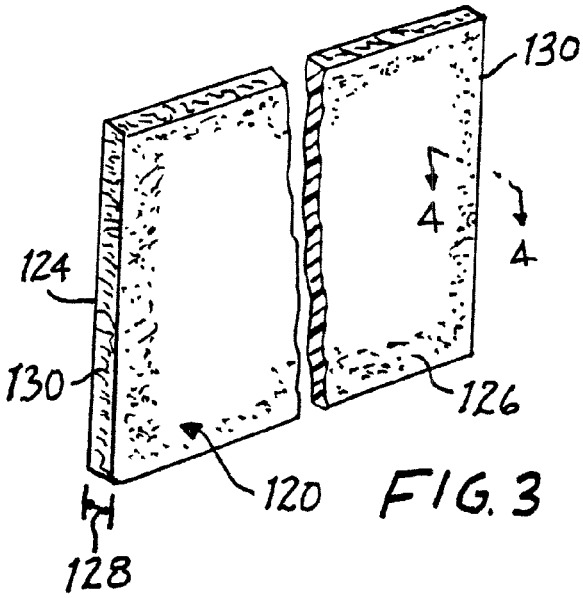
FIG. 3 is a pictorial view illustrating a step in a method of the present invention.
Figure 4:
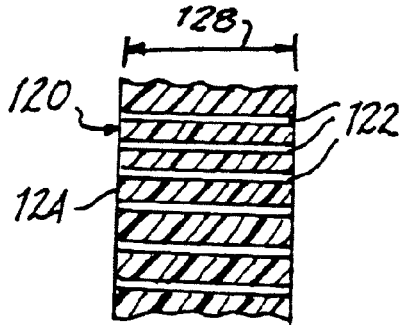
FIG. 4 is an enlarged fragmentary cross-sectional view taken along line 4-4 of FIG. 3, depicted in a schematic form to illustrate a step of the method.

Referring now to the drawing, and especially to FIGS. 1 and 2 thereof, a basket media mill constructed in accordance with the present invention is illustrated at 10 and is seen to include a basket 12 which is to be selectively inserted into a vessel (not shown), as described in the aforesaid U.S. Pat. No. 5,184,783, so as to be immersed in the contents of the vessel. Basket 12 has a generally cylindrical configuration and includes a cylindrical side containment wall 14 extending axially from an entrance 16, at upper end 18, vertically downwardly to a lower end 20. A bottom containment wall 22 has a generally annular configuration and spans the lower end 20 of the side containment wall 14 to completes the interior 24 of the basket 12. Clamps 26 secure the containment walls 14 and 22 in place in basket 12. A media bed 30 is placed within the interior 24 of the basket 12 and is shown as a mass of grinding media comprised of discrete media elements illustrated in the form of beads 32.

A drive shaft 40 extends axially into the basket 12 and is journaled for rotation relative to the basket 12. Columns 42 and 44 support the basket 12 and mount the basket 12 in a secure, fixed position within the vessel. A rotor 50 is coupled to the drive shaft 40 and includes a hub 52 which carries a plurality of stirring rods 54 extending radially outwardly from the hub 52, toward the side containment wall 14 of the basket 12, the stirring rods 54 being placed axially along the hub 52 and arrayed circumferentially around the hub 52. Upon rotation of the drive shaft 40 and the hub 52, the stirring rods 54 will cause the beads 32 to move with a random up and down motion, rather than moving as a mass only in a rotational motion, and a desired shearing or grinding action is attained so as to divide solid material carried by the flow of the contents of the vessel, referred to as feedstock, through the basket 12 and disperse the divided solid material into, and mix the dispersed solid material with, the liquid vehicle of the feedstock. Any tendency toward packing of the media bed 30 is reduced by the movement of the stirring rods 54. Generally, approximately ninety percent of the mixing accomplished within the basket media mill 10 takes place within the basket 12.

A plurality of static rods 60 are affixed to the side containment wall 14 of the basket 12 so as to be stationary relative to the rotating stirring rods 54. The static rods 60 are juxtaposed with counterpart stirring rods 54 for interacting with the counterpart stirring rods 54 to attain combined attrition and rolling shear within the media bed 30, the static rods 60 extending radially inwardly from the side containment wall 14 of the basket 12, toward the hub 52 of rotor 50, axially adjacent counterpart stirring rods 54, so as to tend to stabilize the media bed 30 in radial directions while increasing the combined attrition and rolling shear attained between the static rods 60 and the counterpart stirring rods 54.

Rotor 50 is journaled for rotation within basket 12 and includes a shaft 70 depending from the terminal end 72 of hub 52 of the rotor 50 and extending axially into, and preferably through, a basket bearing shown in the form of a bushing 74 secured to the bottom containment wall 22 of the basket 12. Upon rotation of the drive shaft 40, feedstock is fed into basket 12 through a tubular inlet passage 76 located at entrance 16, assisted by an upper impeller, shown in the form of helical screw impeller 78 coupled with the drive shaft 40. A pressure differential established between the upper impeller and a lower impeller, illustrated in the form of impeller 79, moves the feedstock through the basket 12, and through the media bed 30 within the interior 24 of the basket 12. At the same time, the rotor 50 is rotated to move the stirring rods 54 through the media bed 30.

Heretofore, the size of the media in the media bed 30, that is, the size of the beads 32 of the illustrated embodiment, has been limited to a range extending down to a minimum size of about 0.5 millimeter. This limitation is imposed largely by the ability to contain the beads of a media bed within the media basket of the media basket mill. The size of the divided solids dispersed into the liquid vehicle of a mixture being processed in a basket media mill is related directly to the size of the media in the media bed. In conventional media basket mills, the containment walls of the basket usually are constructed in the form of a metallic grid, with metal bars arranged to provide slots for the passage of feedstock through the containment walls, while the spacing between adjacent bars is made small enough to confine the beads of the media bed within the basket. Thus, in order to meet the requirements for dividing solids into very fine solid constituents and dispersing the fine solid constituents into the liquid vehicle to process a mixture of very fine solid constituents within the liquid vehicle, it becomes necessary to reduce the size of the media itself and to reduce the spacing between bars of the containment walls of the media basket.

However, upon reducing the size of the openings in the containment walls by narrowing the slots in the metallic grid which comprises conventional containment walls, the open area provided by the openings in the containment walls for the flow of feedstock through the containment walls is reduced to a small percentage of the total overall area of the containment walls, the available open area thus being only about three to six percent of the overall area. Accordingly, passage of the feedstock through the containment walls is slowed, and where the complete processing of a feedstock requires recirculation of the feedstock for multiple passes through the media bed to achieve the desired refinement of the solids carried by the feedstock, processing time becomes inordinately high. In addition, constructing a metallic grid with very small openings becomes extremely difficult and very expensive. Thus, it has not been found commercially feasible to employ a basket media mill for grinding and dispersing very fine solids into a liquid vehicle.

The present invention overcomes the above-outlined limitations imposed upon conventional basket media mills with respect to the processing of a feedstock to grind and disperse very fine solids into the liquid vehicle of the feedstock. To that end, side containment wall 14 and bottom containment wall 22 are constructed of a porous synthetic polymeric material having porous openings 80, each porous opening 80 passing through a corresponding containment wall 14 and 22 and having a pore size less than the predetermined size of the beads 32 within media bed 30 such that the beads 32 within the media bed 30 will be confined within the basket 12 of media mill 10 as feedstock is passed through the media bed 30 and the containment walls 14 and 22. The cylindrical configuration of side containment wall 14 includes a cylindrical interior surface 90 having a cylindrical overall area extending between the upper end and the lower end 20 of the side containment wall 14, a cylindrical exterior surface 92 opposite the interior surface 90, and a radial thickness 94 between the interior surface 90 and the exterior surface 92. Bottom containment wall 22 similarly includes an interior surface 100 having an annular overall area extending between a radially inner edge 102 and a radially outer edge 104, an annular exterior surface 108 opposite the interior surface 100, and an axial thickness 110 between the interior surface 100 and the exterior surface 108.

The porous openings 80 have a preferred minimum pore size of about 0.005 millimeter for containing beads 32 having a size of about 0.01 millimeter, with the pore size preferably being within the range of about 0.005 to 0.5 millimeter for containing beads 32 having a corresponding minimum size within the range of about 0.01 to 1.0 millimeter. The porous openings 80 establish an open area within each overall area and populate each containment wall 14 and 22 to the extent that the open area of each containment wall 14 and 22 comprises at least fifteen percent of the overall area of each containment wall 14 and 22, and preferably constitutes about fifteen to sixty percent of each overall area. This relatively large proportion of open area to overall area, as compared to the proportion of open area to overall area heretofore made available by metallic containment walls, facilitates a concomitantly increased volumetric flow of feedstock through the containment walls 14 and 22, and thus through the media bed 30, enabling feedstock to be re-circulated to accomplish multiple passes through the media bed 30 in a relatively short period of time. These quickly-accomplished multiple passes, combined with the ability to maintain very small beads 32 within the media bed 30 in the media basket 12, enables the grinding and dispersion of very fine, and even ultra-fine, solids within the liquid vehicle of the feedstock, with increased speed and with improved energy transfer through the media bed and into the feedstock, utilizing basket media mill 10.

The preferred synthetic polymeric material of containment walls 14 and 22 is a high-density polyethylene. An effective porous high-density polyethylene material having porous openings within the range of sizes set forth above, and providing the desired proportion of open area to overall area, is available commercially under the trademark POREX, sold by Porex Technologies Corp. of Fairburn, Ga.

Turning now to FIGS. 3 through 6, side containment wall 14 is shown being constructed in accordance with the present invention. A substantially flat sheet of porous high-density polyethylene, shown at 120 in FIG. 3, includes a multiplicity of porous openings 122 extending from an obverse surface 124 to a reverse surface 126, the porous openings 122 being illustrated in FIG. 4 in a schematic representation wherein the porous openings 122 are depicted for clarity as ordered, straight cylindrical openings rather than the literal random and convoluted openings which are present in the actual sheet 120. Preferably, sheet 120 has a thickness 128 of about one-quarter inch.

Figure 5:
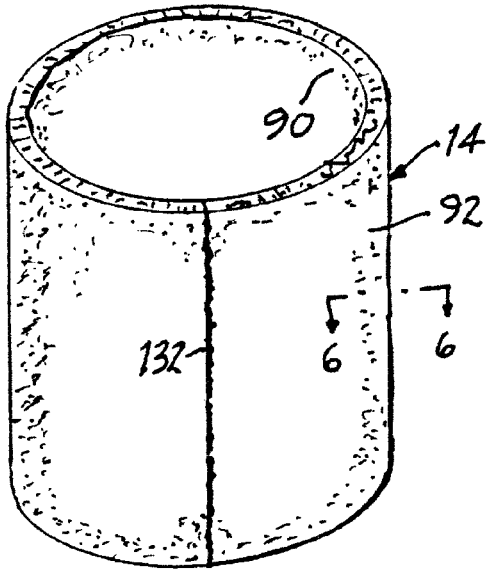
FIG. 5 is a pictorial view illustrating another step in the method.

Sheet 120 then is formed into a cylindrical configuration, as shown in FIG. 5, as by bending and rolling the essentially flat, planar sheet 120, until opposite edges 130 of the sheet 120 are brought into confronting juxtaposition. The confronting edges 130 then are joined together, as by welding or with an adhesive, as shown at 132, to complete the cylindrical configuration of side containment wall 14, with the obverse surface 124 now comprising exterior surface 92 and the reverse surface 126 now comprising interior surface 90.

Figure 6:
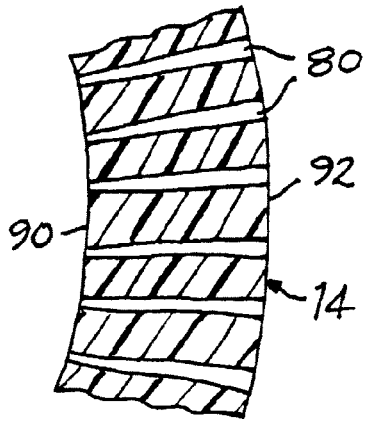
FIG. 6 is an enlarged cross-sectional view taken along line 6-6 of FIG. 5, depicted in a schematic form to illustrate the step of the method.

At the same time, the porous openings 122 are reconfigured such that the pore size of each porous opening 80 of the completed side containment wall 14 increases from the interior surface 90 to the exterior surface 92, as illustrated in FIG. 6, as a result of expansion of the obverse face 124 and compression of the reverse face 126 as the sheet 120 is bent and rolled into the cylindrical configuration. As set forth in the aforesaid U.S. Pat. No. 5,184,783, this tapered configuration of openings 80 is advantageous in that the configuration induces a venturi-like action in the feedstock passing through the openings 80, effecting a higher shear in the mixture of the feedstock as the mixture leaves the basket 12.

Thus, the porous synthetic polymeric containment walls 14 and 22 attain relatively rapid processing of a feedstock to grind and disperse very fine dispersions, employing a combination of the ability to contain a media bed 30 of very small media, preferably in the form of beads 32 ranging in size from about 0.01 to 1.0 millimeter, utilizing porous openings 80 having a pore size in the range of about 0.005 to 0.5 millimeter, with an open area extending over a range of about fifteen to sixty percent of the overall area of a containment wall 14 and 22. In addition, abrasion is reduced at the containment walls of the basket of a basket media mill, thereby reducing wear and increasing longevity of the containment wall. Further, reduced abrasion militates against the possibility of contaminating the feedstock with particles worn from the containment wall, and the use of a synthetic polymeric containment wall, thereby avoiding a metallic containment wall, is a feature which is significant in the processing of pharmaceuticals, cosmetics, and ink-jet ink where either or both metal and color contamination becomes an important factor.

It will be seen that the present invention attains the several objects and advantages summarized above, namely: Enables the processing of feedstock in a basket media mill to disperse more finely divided solids within the feedstock; enables an increased volumetric flow of feedstock through a basket media mill for accelerated processing of the feedstock; increases significantly the open area made available at the containment wall of the basket of a basket media mill for feedstock throughput in the basket media mill, thereby decreasing the dwell time per pass of feedstock through the media field contained within the basket and, consequently, enabling an increased number of passes for improved performance within a given time period; provides greater precision in the size of openings in the containment wall of a basket media mill for more precise control of the size of solids dispersed in the liquid of a selected feedstock; increases resistance to abrasion of the containment wall and consequent attrition of the material of the containment wall; provides better containment of media within the media bed of a basket media mill, thereby avoiding contamination of the feedstock with media; militates against contamination of the feedstock with particles which otherwise might be abraded from the material of the containment wall itself; provides for exemplary performance in the containment of media within the basket of a basket media mill over an extended service life.

It is to be understood that the above detailed description of preferred embodiments of the invention is provided by way of example only. Various details of design, construction and procedure may be modified without departing from the true spirit and scope of the invention, as set forth in the appended claims.

The embodiments of the invention in which an exclusive property or privilege is claimed are defined as follows:

1. In a media basket mill having a basket with a containment wall establishing an interior for containing a bed of media of predetermined size within the basket, while feedstock comprised of solids entrained within a liquid vehicle is passed serially through the bed and thence through the containment wall to grind and disperse the solids within the liquid vehicle, an improvement wherein:

the containment wall is constructed of a porous synthetic polymeric material having porous openings each of a pore size less than the predetermined size of the media for confining the media within the bed in the basket as feedstock is passed through the porous openings in the containment wall, the containment wall extending over an overall area and the porous openings providing an open area through which the feedstock will flow as the feedstock passes through the containment wall, the open area being at least about fifteen percent of the overall area of the containment wall for enabling a concomitant volumetric flow of feedstock through the containment wall.

2. The improvement of claim 1 wherein the open area is about fifteen to sixty percent of the overall area of the containment wall.

3. The improvement of claim 1 wherein the pore size is about 0.005 millimeter for containing media having a minimum size of about 0.01 millimeter.

4. The improvement of claim 1 wherein the pore size is within the range of about 0.005 to 0.5 millimeter for containing media having a corresponding minimum size within a range of about 0.01 to 1.0 millimeter.

5. The improvement of claim 1 wherein the synthetic polymeric material is a high-density polyethylene.

6. The improvement of claim 5 wherein the containment wall has an interior surface confronting the bed of media and an exterior surface opposite the interior surface, and a thickness between the interior surface and the exterior surface of about one-quarter inch.

7. The improvement of claim 5 wherein the containment wall has an interior surface confronting the bed of media and an exterior surface opposite the interior surface, and the pore size of the porous openings increases from the interior surface toward the exterior surface of the containment wall.

8. The improvement of claim 7 wherein the containment wall comprises a cylindrical member.

9. The improvement of claim 1 wherein the containment wall has an interior surface confronting the bed of media and an exterior surface opposite the interior surface, and the pore size of the porous openings increases from the interior surface toward the exterior surface of the containment wall.

10. The improvement of claim 9 wherein the containment wall comprises a cylindrical member.

11. In a method for grinding and dispersing solids within a liquid vehicle in a feedstock passed through a media basket mill having a basket with a containment wall establishing an interior for containing a bed of media of predetermined size within the basket, while the feedstock is passed serially through the bed and thence through the containment wall, an improvement comprising:

constructing the containment wall of a porous synthetic polymeric material having porous openings each of a pore size less than the predetermined size of the media, the containment wall extending over an overall area and the porous openings providing an open area through which the feedstock will flow as the feedstock is passed through the containment wall, and the open area being at least about fifteen percent of the overall area of the containment wall; and confining the media within the bed in the basket while passing the feedstock serially through the media bed and the porous openings in the containment wall, thereby enabling a concomitant volumetric flow of feedstock through the containment wall while the solids are ground and dispersed within the liquid vehicle of the feedstock.

12. The method of claim 11 wherein the containment wall is constructed such that the open area is about fifteen to sixty percent of the overall area of the containment wall.

13. The method of claim 11 including providing the porous openings with a pore size of about 0.005 millimeter and containing media having a minimum size of about 0.01 millimeter.

14. The improvement of claim 11 including providing the porous openings with a pore size within the range of about 0.005 to 0.5 millimeter and containing media having a corresponding minimum size within a range of about 0.01 to 1.0 millimeter.

15. The improvement of claim 11 wherein the synthetic polymeric material is a high-density polyethylene.

* * * * *